US007757466B2

(12) United States Patent
Conti

(10) Patent No.: US 7,757,466 B2
(45) Date of Patent: Jul. 20, 2010

(54) UNIT FOR PACKAGING ARTICLE CONTAINING INFUSION PRODUCT

(75) Inventor: Roberto Conti, Imola (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 629 days.

(21) Appl. No.: 11/578,677

(22) PCT Filed: Dec. 14, 2005

(86) PCT No.: PCT/IB2005/003982

§ 371 (c)(1),
(2), (4) Date: Oct. 17, 2006

(87) PCT Pub. No.: WO2006/067619

PCT Pub. Date: Jun. 29, 2006

(65) Prior Publication Data

US 2009/0087294 A1 Apr. 2, 2009

(30) Foreign Application Priority Data

Dec. 20, 2004 (IT) ..... BO2004A0785

(51) Int. Cl.
*B65B 35/50* (2006.01)

(52) U.S. Cl. ..... 53/540

(58) Field of Classification Search ..... 53/447, 53/531, 532, 534, 536, 540, 543
See application file for complete search history.

(56) References Cited

U.S. PATENT DOCUMENTS

| | | | | | |
|---|---|---|---|---|---|
| 4,679,379 | A * | 7/1987 | Cassoli | 53/438 |
| 4,706,440 | A * | 11/1987 | Bittner | 53/438 |
| 4,796,409 | A * | 1/1989 | Rimmer et al. | 53/438 |
| 5,459,980 | A * | 10/1995 | Kenney et al. | 53/450 |
| 5,675,963 | A * | 10/1997 | Nicholson et al. | 53/540 |
| 7,096,650 | B2 * | 8/2006 | Van Dam | 53/540 |
| 7,367,172 | B2 * | 5/2008 | Conti | 53/553 |
| 2003/0192289 | A1 * | 10/2003 | Lohrey et al. | 53/447 |
| 2005/0268577 | A1 * | 12/2005 | Kuss et al. | 53/551 |

FOREIGN PATENT DOCUMENTS

| | | |
|---|---|---|
| EP | 0 791 537 A1 | 8/1997 |
| GB | 1 226 481 B | 11/1963 |
| GB | 2 278 822 A | 12/1994 |
| WO | 99/37542 A1 | 7/1999 |

* cited by examiner

*Primary Examiner*—Hemant M Desai
(74) *Attorney, Agent, or Firm*—Arent Fox LLP

(57) ABSTRACT

A unit (100) for packaging articles (1) containing a product for infusion, preferably filter paper coffee pods (1), is of the type comprising at least one operating stacking station (8) for stacking the pods (1) in such a way as to form at least one stack (1*a*, 1*b*) of pods (1). The stacking station (8) comprises a device (9) for handling the pods (1) which guides and controls the stack (1*a*, 1*b*) of pods (1) as it is fed into a respective bag-like packet (11).

11 Claims, 9 Drawing Sheets

UNIT FOR PACKAGING ARTICLE CONTAINING INFUSION PRODUCT

CROSS REFERENCE TO RELATED APPLICATION

This application is a National Stage entry of International Application No. PCT/IB2005/003982 filed Dec. 14, 2005, which claims priority of Italy Application Number BO2004A000785 filed Dec. 20, 2004, the entire specification, claims and Drawings of which are incorporated herewith by reference.

TECHNICAL FIELD

The present invention relates to a unit for packaging articles containing a product for infusion.

In particular, the invention is advantageously used to package stacked groups of single-use pods of filter paper containing measured quantities or charges of infusion product such as tea, barley coffee, chamomile and the like, preferably powdered coffee, in bag-like packets to which this specification expressly refers but without thereby restricting the scope of the invention.

BACKGROUND ART

Usually, an automatic machine for making filter-paper pods, containing doses of infusion product comprises a production line having a plurality of operating stations located one after the other along it and at the end of which a continuous strip of pods, that is to say, two superposed webs of filter paper heat sealed to each other and having interposed, at regular intervals, a plurality of infusion product charges, is divided up at a cutting station into individual single-use pods separated by waste material.

Downstream of the cutting station, the pod making machine has an end outfeed station equipped with pick and place means designed to pick up the pods one by one and place them on conveyors that transport them to packaging devices which wrap them in respective heat-sealed overwraps. In another solution, which this invention specifically refers to, the outfeed station comprises conveyor means for advancing the groups of pods, preferably stacked, towards packaging units where the groups of pods are picked up and fed by complex mechanical devices into forming assemblies which pack them in packages such as, for example, bag-like packets.

In other words, packaging the groups of pods requires conveyor means for handling and moving the pods from the machine that makes them to the bagging units which, in some cases, may be located some distance away.

A structure of this kind has considerable disadvantages due not only to the presence of the conveyor means required to transport the grouped pods to the packaging units, which greatly increase the overall dimensions of the pod making machine that mounts them, but also and above all to the complexity of the mechanical structural components of the packaging units themselves.

Other major difficulties are caused by the handling and positioning of the pod stacks since the pods are gravity fed into the bags in an uncontrolled manner leading to their being incorrectly arranged in the bags.

The aim of this invention is to provide a pod packaging machine that is free of the above mentioned disadvantages.

DISCLOSURE OF THE INVENTION

This invention accordingly provides a unit for packaging articles containing a product for infusion, of the type comprising at least one operating stacking station for stacking the articles in such a way as to form at least one stack of articles; the unit being characterised in that the stacking station comprises a device for handling the articles which guides and controls the stack of articles as it is fed into the bag-like packet.

DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
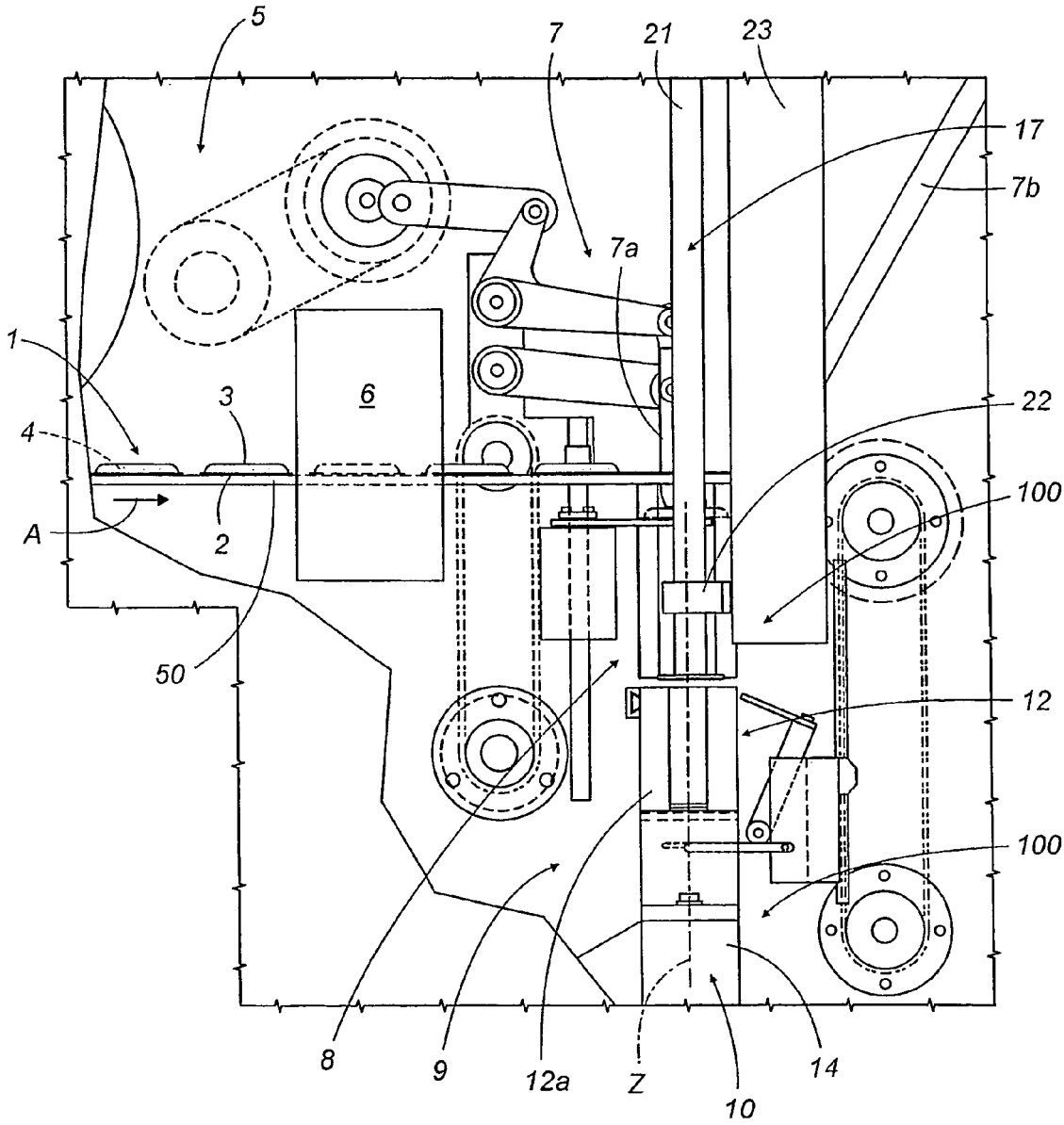
FIG. 1 is a front view, partly in cross section and with some parts cut away for clarity, of a preferred embodiment of the unit for packaging articles containing infusion product integrated in a machine that makes the articles.
Figure 2:
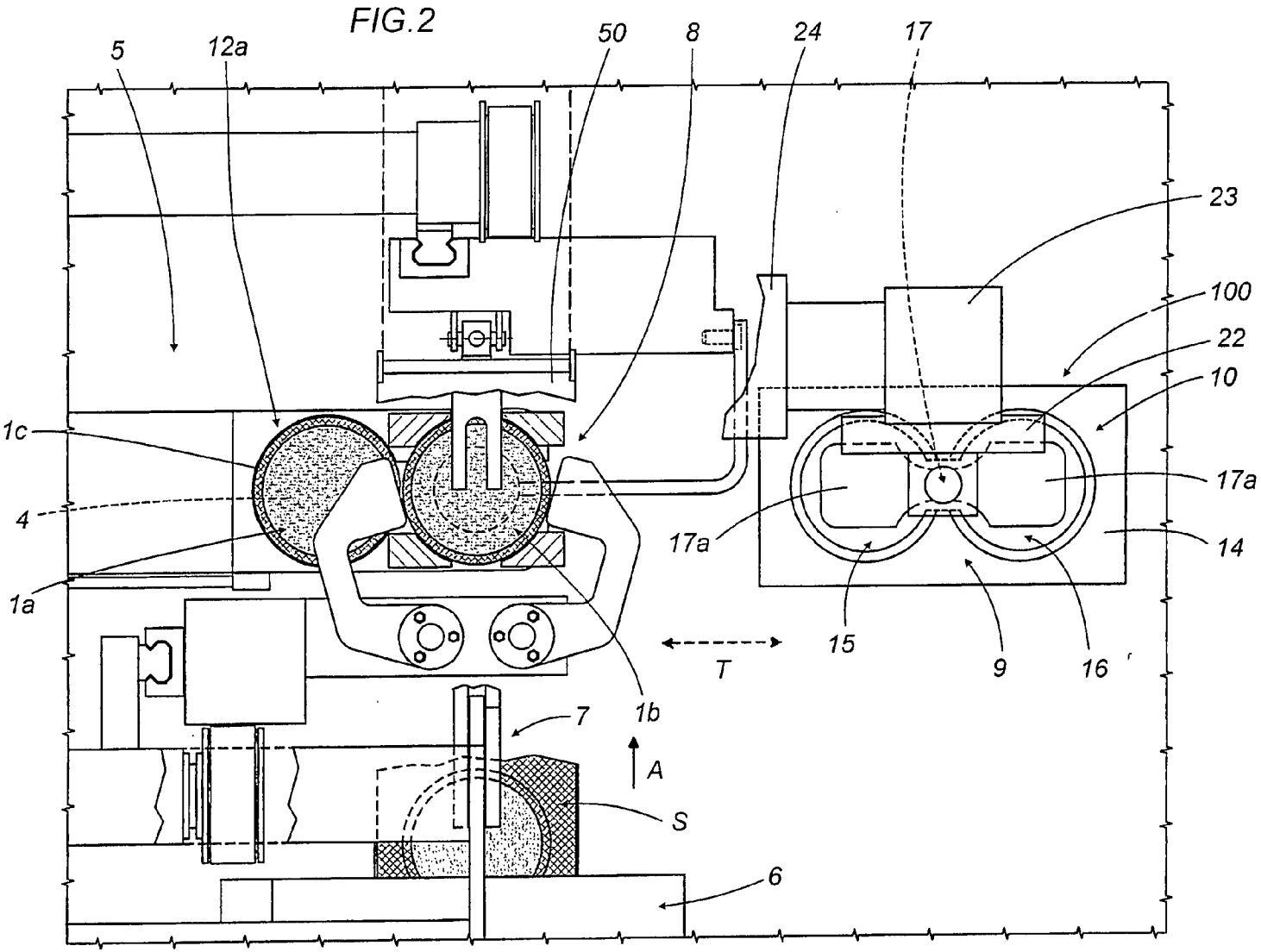
FIG. 2 is a plan view of the unit of FIG. 1.
Figure 3:
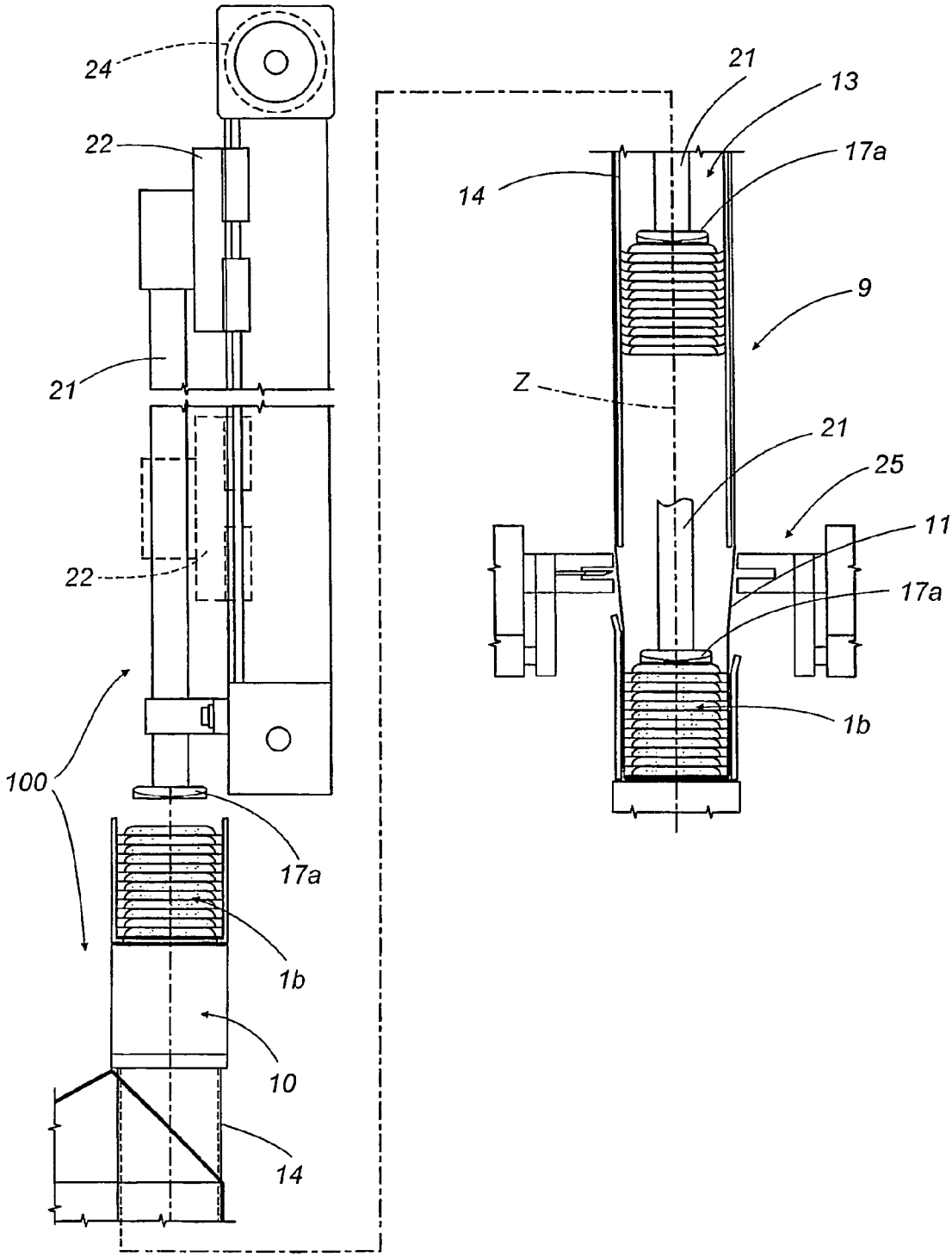
FIG. 3 is a schematic side view of the packaging unit of FIG. 1 in different operating positions.

With reference to the accompanying drawings, in particular FIGS. 1 and 2, the numeral 100 denotes in its entirety a packaging unit according to the invention which is mounted on a machine for making articles, especially pods 1 of filter paper containing powdered coffee and which is designed to package the pods in groups in bag-like packets.

The pod 1, in this non-restricting embodiment of the invention, is of well-known type, comprising two lengths 2 and 3 of filter material placed face to face and joined to each other by sealing round the edges after a charge 4 has been placed on the surface of only one of the lengths to form the pod 1.

The pod making machine, labeled 5 as a whole in FIGS. 1 and 2, is of the type comprising a plurality of operating stations located in succession along a production line A extending in a substantially horizontal direction. More specifically, the machine 5 comprises: a plurality of operating stations for arranging the pods 1 in their final configuration, consisting of at least one continuous strip S obtained by superposing two webs of filter material with charges 4 of infusion product interposed and distributed at regular intervals; an operating station 6 where the two superposed webs are sealed to each other to form the strip S, and where the strip S itself is subsequently cut at least in the area surrounding each charge 4 to make individual pods 1; and a station 7 for separating the individual pods 1 from waste material or trimmings S1 of the strip S itself.

The separating station 7 comprises a pusher element 7*a* located downstream of the station 6 and designed to push the individual pods 1 vertically under the feed table 50.

The separating station 7 also comprises a unit 7*b* for expelling the waste trimmings S1 downstream of the pusher 7*a* with respect to the production line A.

As illustrated in FIGS. 1 to 4, the unit 100 comprises a stacking operating station 8 for making up stacks 1*a*, 1*b* with the pods 1 made by the machine 5, and a handling device 9 for guiding each made up stack 1*a*, 1*b* of pods 1 into a bag-like container 11.

The device 9 comprises means 10, 17 for guiding the stacked pods 1 along a vertical feed path section Z towards an end 11*a* of the packet 11 positioned at the bottom end 9*a* of the device 9 itself.

As clearly shown in FIGS. 8 to 12, the section Z is parallel to a stacking axis Z1 of the pods 1 at the station 8.

During use, the device 9 (FIGS. 3 and 4), besides guiding the pod 1 stacks 1*a* 1*b* as they are fed down into the bag-like packet 11, also defines surfaces for forming the packet 11 itself.

As shown in FIGS. 1 and 2, the station 8 further comprises means 12 for conveying and positioning the stacks 1*a*, 1*b* of pods 1 on the device 9.

Preferably, the conveying means 12 consist of a carriage-like bucket 12*a* reciprocatingly mobile along a horizontal path T transversal to the direction of the line A (FIGS. 1 and 2, and FIGS. 10 to 12) or, alternatively, conveyor belts combined with guides and pushers capable of transporting the stack or stacks 1*a* and 1*b* to be packaged.

As shown in FIGS. 1 to 4, the guide and controlled downfeed means 10, 17 comprise a vertical channel 13 consisting of a hollow element 14 located in the vicinity of the stacking station 8 (that is to say, at the side or front of the station 8), the channel 13 having an inside section that defines at least one area 15, 16 for the passage of the pods 1; and a pod 1 pushing/accompanying element 17 located above the hollow element 14 and mobile vertically along the channel 13 in such a way that the pods 1 interfere with the channel 13, and thereby guiding and pushing the pods 1 into the bag-like packet 11.

The pusher element 17 moves between an idle position where the element 17 is away from the inlet opening at the top of the hollow element 14 (FIGS. 1, 2 and 3), and a working, pod 1 guiding and pushing position where the element 17 slides along the inside of the channel 13 so as to position the pods 1 in the bag-like packet 11.

In practice, the pusher element 17 is designed to accompany the pods 1 and to push them all the way into the bag-like packet 11.

Figure 6:
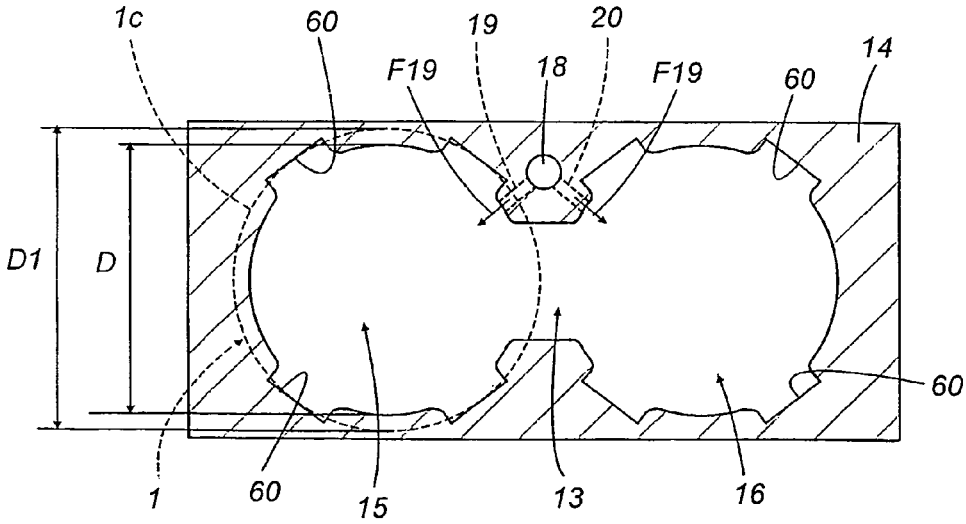
FIG. 6 is a cross section through a horizontal plane of a part of the packaging unit according to the invention.

As better shown in FIG. 6, since each pod 1 is substantially disc-shaped, with a defined diameter D1, the cross sectional profile of the channel 13 of the hollow element 14 defines at least two adjacent circular zones 15 and 16, with a binocular-like shape to permit simultaneous guided downfeed of two side-by-side stacks 1*a* and 1*b* of pods 1.

FIG. 6 also shows that the two circular zones 15 and 16 for access by the pod 1 stacks 1*a* and 1*b* have a diameter D that is smaller than the diameter D1 of the pods 1 so as to control the pods 1 more effectively as they are pushed down along the channel 13.

Figure 5:
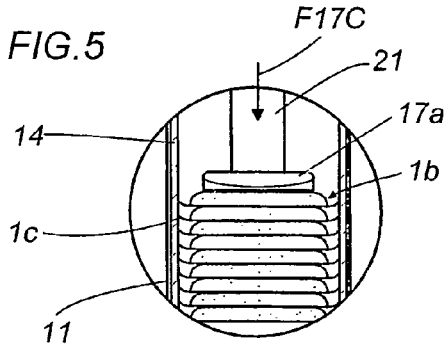
FIG. 5 is an enlarged view of a detail of the unit of FIG. 3.

Obviously, to be able to correctly control downfeed, the diameter D of the zones 15 and 16 is just a little smaller than the diameter D1 of the pods 1, taking into account the outer ring 1*c* of the pod 1 (surrounding the central portion defined by the coffee charge 4) formed by the superposed webs of filter paper which are flexible and easily deformed when the stacks 1*a* and 1*b* are pushed into the channel 13 but creating just enough interference (as shown by the detail view of FIG. 5) to prevent the pods 1 from falling in an uncontrolled manner down the channel 13.

Figure 7:
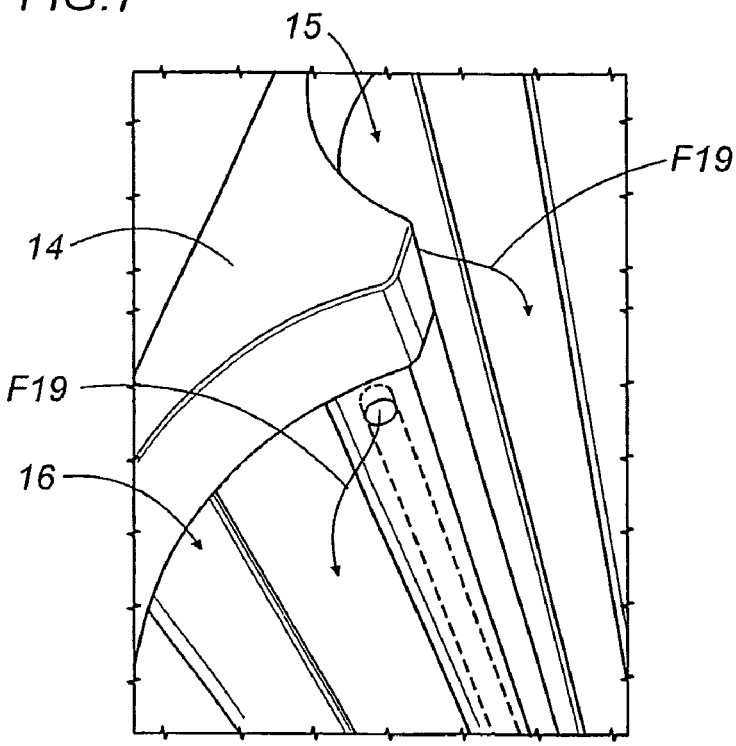
FIG. 7 is a perspective view of a detail from FIG. 6.

As illustrated in FIGS. 6 and 7, the hollow element 14 is equipped with a longitudinal conduit 18 for conveying a fluid or inert gas (for example, nitrogen) positioned centrally between the two circular zones 15 and 16, and leading into at least one bottom opening 19 through which the fluid itself is fed into the hollow element 14: thus, the inert fluid is blown onto the pods 1 as to prevent damage to the pods 1 as they move down into the packet 11 (arrows F19, FIG. 7).

For better and more even distribution of the fluid, the longitudinal conduit 18 leads into at least two opposite openings 19 and 20, one for each of the circular zones 15 and 16. The fluid flow is directed from the bottom up in the channel 13.

Further, each circular zone 15 and 16 has radial grooves 60 around its circumference extending for the full length of the circular zones 15 and 16 to enable air to escape in the direction opposite the downward direction of motion of the stacks 1*a*, 1*b* towards the packet 11.

The other component of the device 9 is the aforementioned pushing/accompanying element 17 which comprises a flat head 17*a* designed to come into contact with the pods 1 so as to push and guide the pods down the circular zones 15 and 16. The head 17*a* is preferably two-lobed to allow two stacks 1*a* and 1*b* of pods 1 to be pushed simultaneously (FIG. 2).

The head 17*a* is also associated with a vertical rod 21 that slides along guides 22 associated with a vertical column 23 located above the hollow element 14.

The rod 21 is preferably driven by a variable-speed motor 24 (for example, a brushless motor) positioned at the top end of the column 23 (see FIG. 3) which moves it between the aforementioned idle and working positions.

Figure 4:
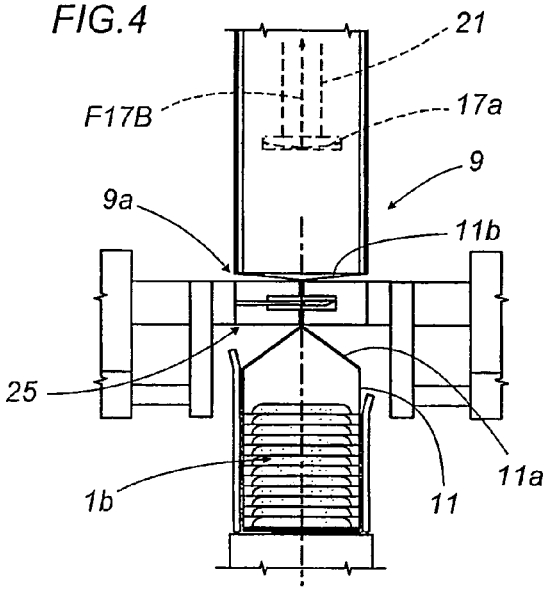
FIG. 4 is a side view of a detail of the unit illustrated in FIG. 3.
Figure 8:
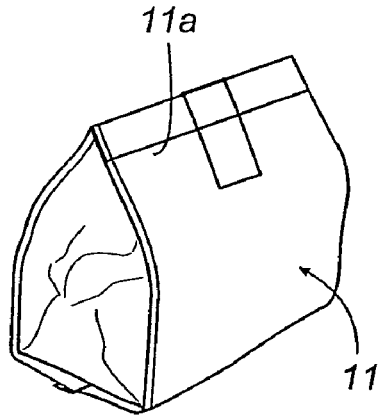
FIG. 8 shows a perspective view of a finished bag-like packet made by the packaging unit according to the invention.
Figure 9:
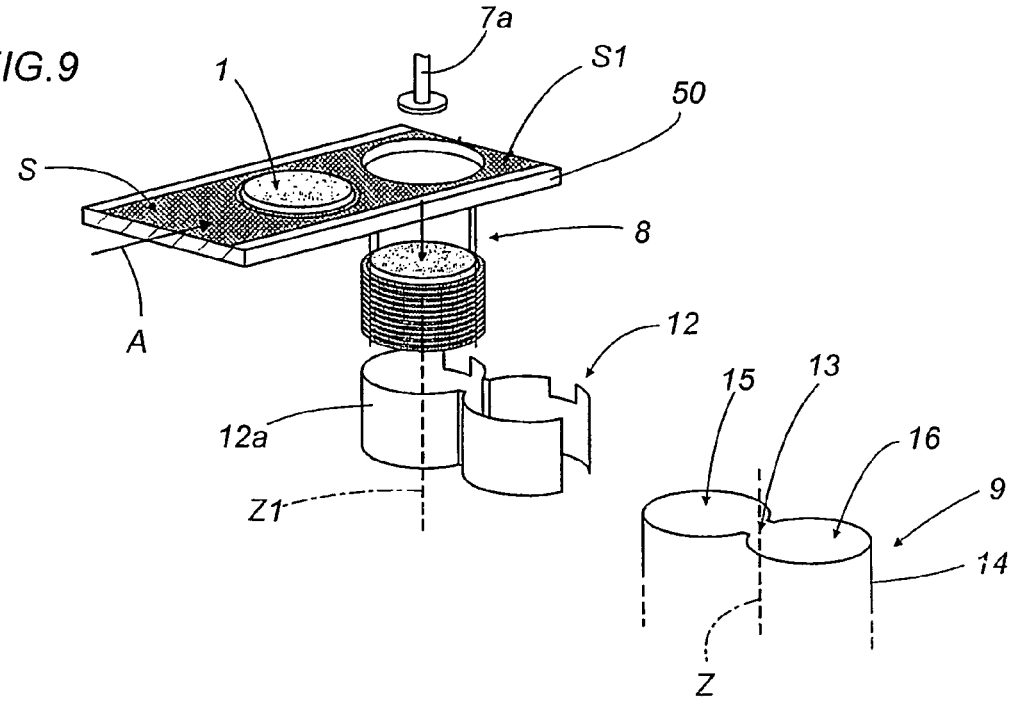
FIGS. 9 to 14 schematically illustrate, in respective perspective views, a succession of operations performed by parts of the packaging unit according to the invention.
Figure 10:
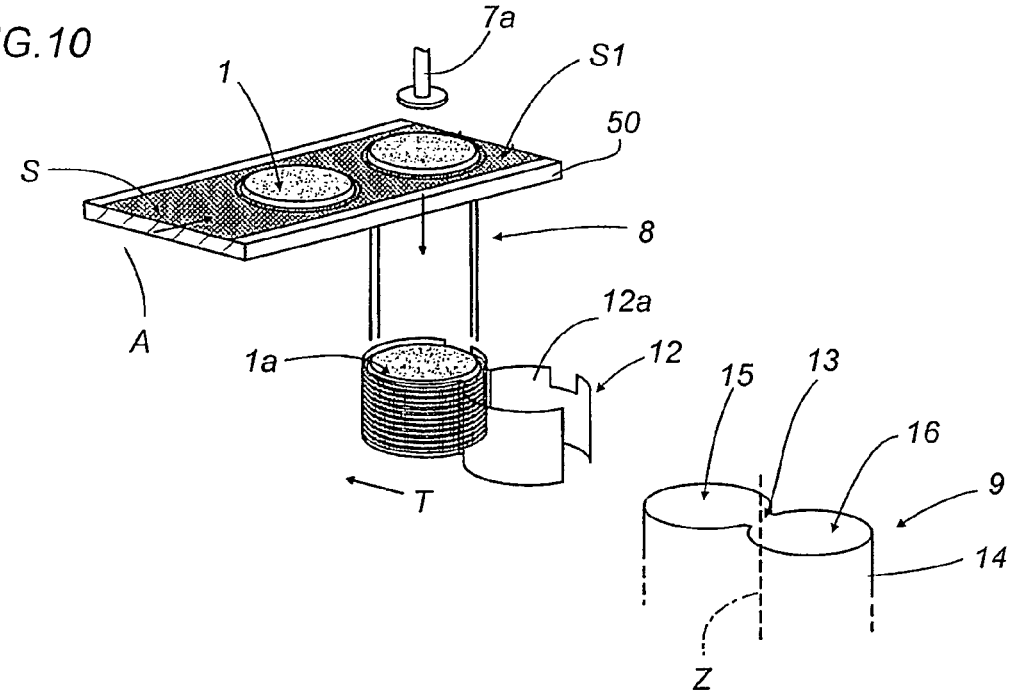
Figure 11:
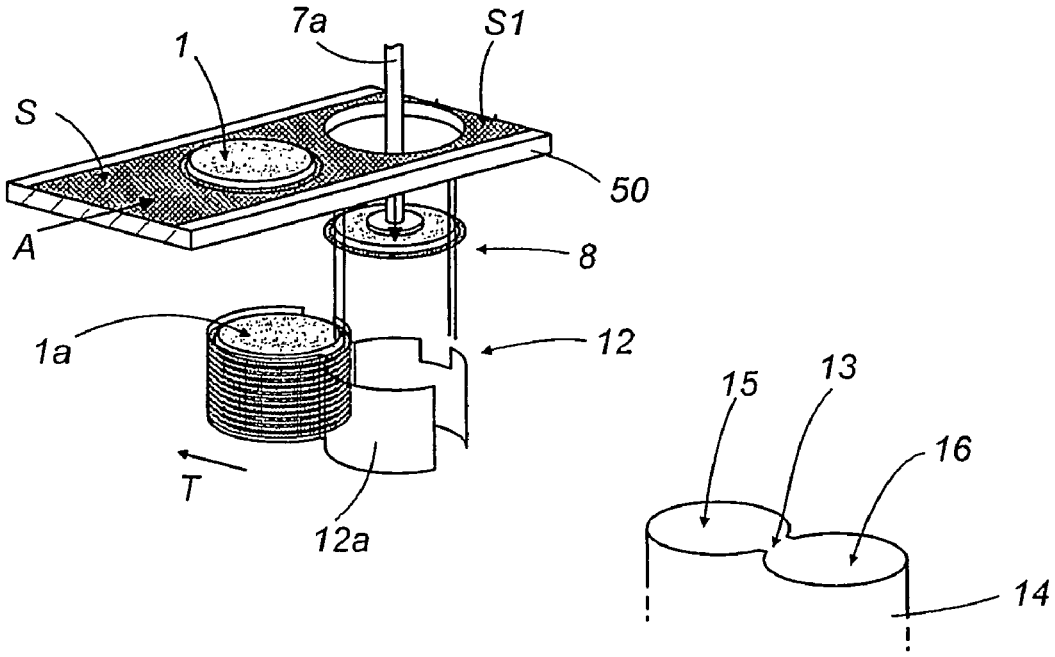
Figure 12:
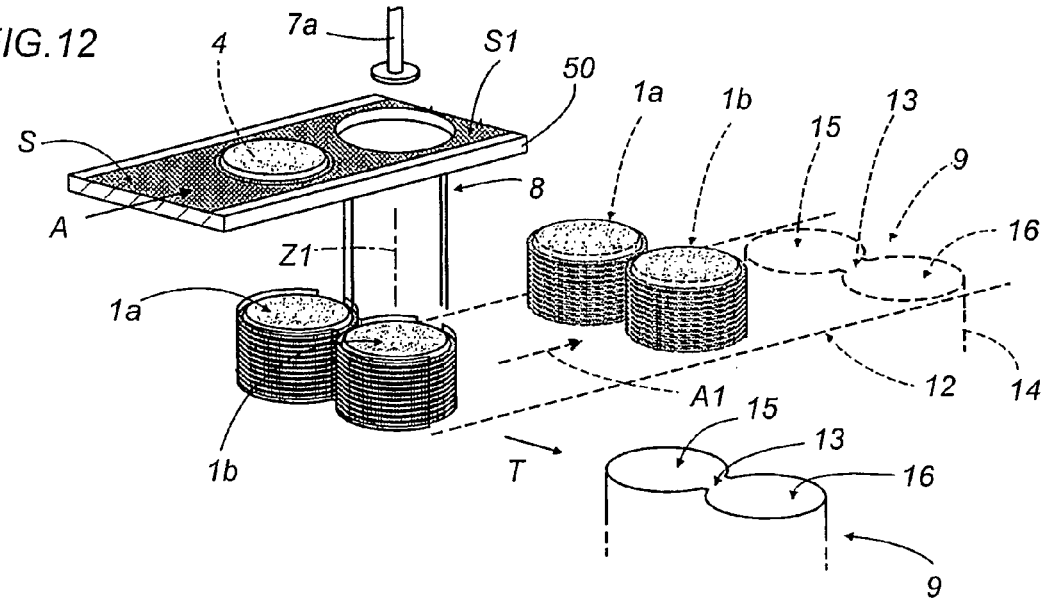
Figure 13:
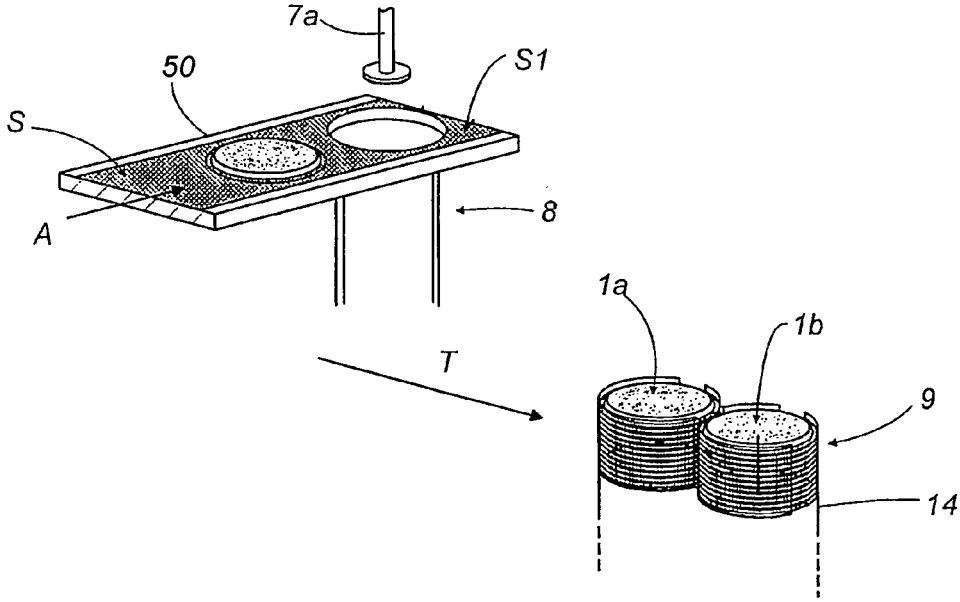
Figure 14:
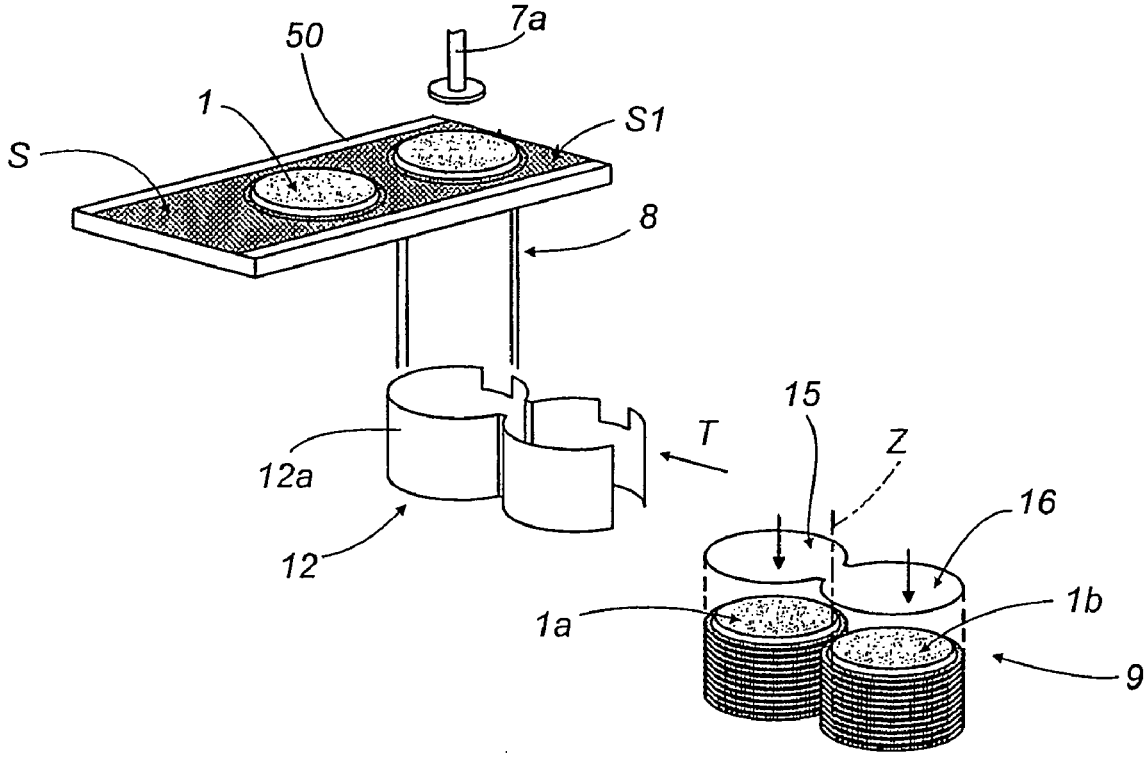

At the lower end 9*a* of the hollow element 14, there is a sealing and cutting device 25 designed to close the inlet opening 11*a* of the bag-like packet 11 and to simultaneously form the base 11*b* of the next packet 11 being formed around the hollow element 14 (FIG. 4 and FIG. 8).

Below is a description of how the packaging unit 100 according to the invention works.

Once the stacks 1*a*, 1*b* of pods 1 have been made in the stacking station 8, the stacks 1*a* and 1*b* (defining the final quantity and arrangement to be accommodated in the packet 11) are transferred along T to the device 9.

At this point, the pair of stacks 1*a* and 1*b* are pushed downwards in guided manner along the vertical channel 13 by the element 17 (arrow F17C, FIGS. 3 and 4) until the stacks 1*a* and 1*b* are fully inside the bag-like packet 11.

Once the stacks 1*a*, 1*b* are inside the packet 11, the pushing/accompanying element 17 can move back up (arrow F17B, FIG. 4) and the top end 11*a* of the bag-like packet 11 sealed.

A packaging unit structured as described above therefore achieves the aforementioned aims thanks to two simple elements for positioning and controlling the downfeed of the pods and permitting accurate and steady placement of the pods, all in an extremely compact structure.

The solution according to the invention offers several advantages such as, for example, a reduction in the space required for transit between the area where the pods are made and the area where they are packaged, making it possible to integrate the packaging station into the pod making machine, an overall reduction in the number of working parts and stations making up the packaging station, thereby lowering the production cost of the machine as a whole, while at the same time allowing higher operating speeds to be achieved. Moreover, the packaging unit according to the invention makes it possible to significantly increase obtainable packaging speeds because the pod stacks are pushed down into the bags at a higher speed than can be achieved by gravity alone.

It will be understood that the invention as described herein can be modified and adapted in several ways without thereby departing from the scope of the inventive concept. Moreover, all the details may be substituted by technically equivalent elements.

The invention claimed is:

1. A unit for packaging articles containing a product for infusion, of the type comprising at least one operating stacking station for stacking the articles in such a way as to form at least one stack of articles, a handling device for handling the articles which guides and controls the stack of articles as it is fed into the bag-like packet; wherein the handling device comprises guide elements comprising a vertical channel consisting of a hollow element located at the stacking station and having an inside section that defines at least one area for the passage of the articles; said handling device defining surfaces enabling the bag-like packet itself to be formed around the hollow element.

2. The unit according to claim 1, wherein the guide elements of the handling device comprise an article pushing/accompanying element located above the hollow element and reciprocatingly mobile along the channel in such a way as to move the articles towards and into packet.

3. The unit according to claim 2, wherein the pushing/accompanying element is movable between an idle position where the element is away from the top end of the hollow element, and a working position where the element slides along the inside of the channel so as to insert the stack of articles into the bag-like packet.

4. The unit according to claim 2, wherein the pushing/accompanying element comprises a flat head designed to come into contact with the articles so as to push and guide the articles down the zone; the head being associated with a vertical rod that slides along guides associated with a vertical column located above the hollow element; the rod being driven by a variable-speed motor positioned at the top end of the column.

5. The unit according to claim 2, wherein each article is disc-shaped; the channel having two zones, each with a substantially circular cross-sectional profile, so as to permit simultaneous guided downfeed of two side-by-side stacks of articles.

6. The unit according to claim 5, wherein the hollow element is equipped with a longitudinal conduit for conveying a fluid, the conduit being positioned centrally between the two circular zones of the hollow element and leading into at least one bottom opening through which the fluid itself is fed into the channel and is blown onto the pods.

7. The unit according to claim 6, wherein the fluid is an inert gas, preferably nitrogen.

8. The unit according to claim 6, wherein the circular zones of the hollow element have radial grooves extending lengthways for the full length of the circular zones themselves.

9. The unit according to claim 1, wherein the handling device comprises at a lower end of the hollow element a sealing cutting device designed to close an inlet opening of the bag-like packet being formed around the hollow element.

10. The unit according to claim 1, wherein the stacking station further comprises conveying means for conveying and positioning the stack of articles on the handling device; said conveying means being defined by at least one carriage-like bucket designed to hold the stack and reciprocatingly mobile in a horizontal direction.

11. A machine for making pods of filter paper containing powdered product for infusion comprising: an operating station for superposing and sealing two webs to form a strip containing charges of infusion product, cutting the strip at least in areas surrounding each charge to make individual pods; a separating station for separating the individual pods from the strip; a unit for packaging said pods comprising a stacking station for making up stacks with the individual pods separated by the separating station; a handling device for handling the stacks of pods which guides and controls each stack of pods as it is fed into a bag-like packet; the handling device comprising guide elements comprising a vertical channel consisting of a hollow element located at the stacking station and having an inside section that defines at least one area for the passage of the pods; said handling device defining surfaces enabling the bag-like packet itself to be formed around the hollow element.

* * * * *